US006405811B1

(12) United States Patent
Borchardt

(10) Patent No.: US 6,405,811 B1
(45) Date of Patent: Jun. 18, 2002

(54) SOLID LUBRICANT FOR AIR COOLED DRILL BIT AND METHOD OF DRILLING

(75) Inventor: Ed G. Borchardt, Tower, MN (US)

(73) Assignee: Baker Hughes Corporation, Houston, TX (US)

( * ) Notice: Subject to any disclaimer, the term of this patent is extended or adjusted under 35 U.S.C. 154(b) by 0 days.

(21) Appl. No.: 09/663,604

(22) Filed: Sep. 18, 2000

(51) Int. Cl.[7] ..... E21B 10/24
(52) U.S. Cl. ..... 175/337; 175/227; 384/93
(58) Field of Search ..... 175/227, 228, 175/337, 371, 372; 384/93

(56) References Cited

U.S. PATENT DOCUMENTS

| | | | | | |
|---|---|---|---|---|---|
| 1,017,935 A | * | 2/1912 | Watres | 138/97 |
| 3,820,612 A | | 6/1974 | Snyder et al. | 175/70 |
| 4,381,824 A | | 5/1983 | Pastusek | 175/229 |
| 4,386,668 A | | 6/1983 | Parish | 175/228 |
| 4,412,590 A | * | 11/1983 | Daly | 175/229 |
| 4,428,442 A | * | 1/1984 | Steinke | 175/228 |
| 4,805,709 A | * | 2/1989 | Johnsey et al. | 175/228 |
| 5,881,829 A | | 3/1999 | Dimond et al. | 175/378 |

* cited by examiner

*Primary Examiner*—David Bagnell
*Assistant Examiner*—Brian Halford
(74) *Attorney, Agent, or Firm*—Bracewell & Patterson, L.L.P.

(57) ABSTRACT

A solid lubricant is added to the internal passages of an air cooled bit such that the air erodes, or ablates, the solid lubricant into the air stream. Compressed air travels down the drill stem to the bit. The air passes through an air tube into the main air passage where the solid lubricant has been placed. As the air passes the solid lubricant, it erodes the solid lubricant. The solid lubricant particles ablated into the air stream travel through the ball passage into the journal air passage and out to the bearing surfaces between the cutter and the journal. The air stream both cools the surfaces and deposits the solid lubricant to reduce the friction between the bearing surfaces.

14 Claims, 2 Drawing Sheets

SOLID LUBRICANT FOR AIR COOLED DRILL BIT AND METHOD OF DRILLING

BACKGROUND OF THE INVENTION

1. Field of the Invention

The present invention relates generally to earth boring bits of the rolling cutter variety. More specifically, the present invention relates to the lubrication of the bearing surfaces of air cooled rolling cutter bits for mining applications, principally drilling blast holes for recovery of minerals.

2. Description of the Related Art

The original rolling-cone rock bit was invented by Howard R. Hughes, U.S. Pat. No. 939,759, and drilled through the hard caprock at the Spindletop field near Beaumont, Texas with relative ease. Since that initial discovery, the rolling-cone rock bit has been widely used and refined by the oil and gas industry.

Earth-boring or rock bits of the rolling-cutter variety are also useful in penetrating earthen formation for purposes other than the production of petroleum. These applications are generally referred to as "mining" applications. A principal application for mining bits is the drilling of blast holes. Blast holes are relatively shallow holes (compared to those drilled for the production of petroleum) in the earth that are used for a variety of purposes, but primarily to insert explosives into the earth for opening subterranean mine cavities.

While petroleum production holes are typically filled with drilling mud during drilling, blast holes use air to accomplish many of the same goals. The air is pumped down the drill pipe into the bit, and returns along the space between the pipe and the hole to the top of the hole. A bit will typically have nozzles that direct the air out of the bit towards the earth being broken up by the cutters so that the debris may be carried up by the air flow to the top of the hole. The bit may also direct some of the air into internal passages to cool the frictional surfaces that are damaged by the extreme heat developed by the drilling action.

Snyder, et al (U.S. Pat. No. 3,820,612) discloses a method for lubricating the bearing surfaces between the cutters and the journal bearings of a typical roller-cone bit. Snyder discloses the introduction of a mixture of water and lubricating additives into the air stream at the top of the hole. As the air travels down the drill pipe and through the internal passages of the bit the air not only cools the bit, it also deposits the lubricating additive thus prolonging bit life. This requires the expensive addition of a water pump and a means for metering out the appropriate amount of water and lubricant to lubricate the bit without clogging up the hole.

Pastusek (U.S. Pat. No. 4,381,824) discloses the use of solid lubricant mounted in the cutter and journal bearing of the bit such that the lubricant is biased into contact with the wear surfaces. The lubricant is biased, using either a spring or air pressure, into the bearing surfaces where the journal and the cone meet. As the lubricant is worn down, the biasing means provides continuous feed of the lubricant. The lubricants disclosed for this use are soft metals such as silver, lead, copper, indium, and tin.

Parish (U.S. Pat. No. 4,386,668) discloses a bit with a liquid lubricant reservoir within the bit wherein the liquid lubricant is pressurized by the compressed air coming down the drill pipe via a piston. There is also a means for releasing excess pressure when the temperatures rise inside the bit and cause the liquid lubricant to expand beyond a predetermined limit. This system requires that the bearing surfaces lubricated by the liquid be sealed from the other bearing surfaces so that the liquid is not simply released into the hole.

BRIEF SUMMARY OF THE INVENTION

A solid lubricant is added to the internal passages of an air cooled bit such that the compressed air erodes the lubricant into the air stream, which then passes through the bearing surfaces between the cutter and the journal. The air stream, laden with ablated solid lubricant particles, both cools the surfaces and deposits the solid lubricant to reduce the friction between these surfaces.

DETAILED DESCRIPTION OF THE PREFERRED EMBODIMENT

Figure 1:
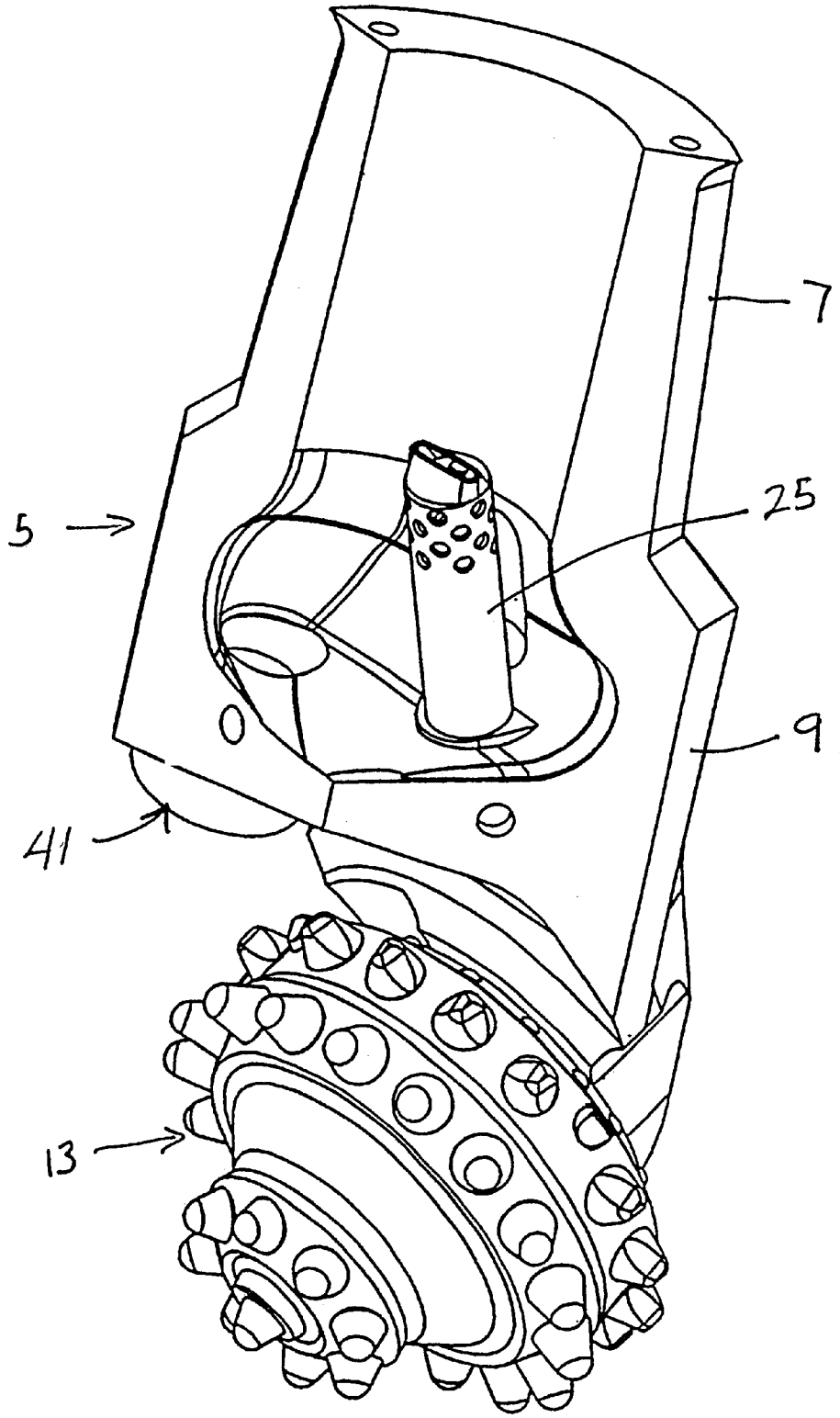
FIG. 1 is perspective view, looking down at an angle towards the cutter, of a single leg of a roller-cone bit constructed in accordance with this invention, with the other two legs not shown.
Figure 2:
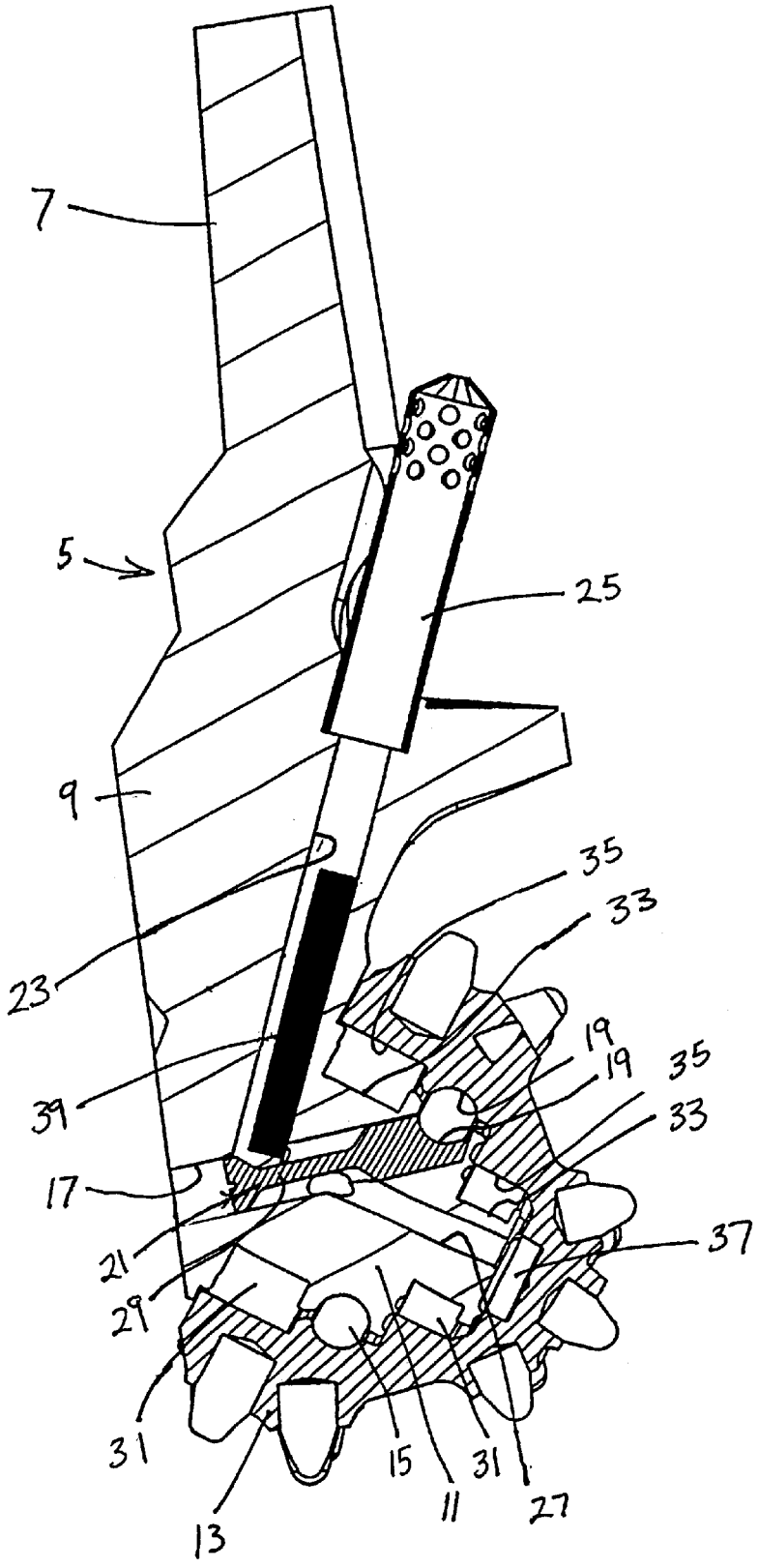
FIG. 2 is a cross-sectional view of a leg of a roller-cone bit constructed in accordance with this invention.

FIG. 1 is a perspective view of a single leg 5 of a roller-cone bit constructed in accordance with this invention. The leg 5 is comprised of a stem portion 7, a body portion 9 and a bearing shaft 11 (FIG. 2). A bit would be made up of three such legs 5 as is well known in the art. When all three legs 5 are joined to form a bit the stem portions 7 will form the hollow threaded stem while the body portions 9 form the body of the bit. As discussed below, the bearing shafts 11 support rolling cone cutters 13.

FIG. 2 is a sectional view of the leg 5 shown in FIG. 1. Each bearing shaft 11 supports a rolling cone cutter 13. The cutter 13 is held on the bearing shaft 11 by ball elements 15 in this embodiment. A ball passage 17 extends from an outer surface of leg 5 and intersects the upper section of bearing shaft 11. The ball elements 15 are inserted through the ball passage 17 into the aligned ball grooves 19 once the cutter 13 has been placed over the bearing shaft 11. A ball plug 21 then fills the ball passage 17 to retain the ball elements 15 in the grooves 19. Retaining rings and other retaining systems are common in the field and are also compatible with this invention.

Each leg 5 of the bit has a main air passage 23 that is topped with an air tube 25. The main air passage 23 leads from the base of the stem portion 7 to the ball passage 17. Air tube 25 is located at the upper end of the main air passage 23. The air tube 25 is perforated to prevent debris and cuttings from entering the main air passage 23. A bearing shaft air passage 27 leads from the ball passage 17 to the end of the bearing shaft 11. In the preferred embodiment the ball plug 21 has a reduced diameter middle section 29 to allow the air to pass from the main air passage 23 to the bearing shaft air passage 27.

Cylindrical roller bearings 31 are located around the bearing shaft 11 to reduce the friction between the bearing shaft 11 and the cutter 13. The roller bearings 31 are between the bearing shaft roller bearing grooves 33 and the aligned cutter roller bearing grooves 35. A thrust bearing 37 is at the end of the bearing shaft 11 to handle axial loads. These bearings 31, 37 are cooled by the compressed air provided from the surface.

A stick of solid lubricant 39 is located in main air passage 23. In the preferred embodiment the solid lubricant 39 is a cylindrical bar, but square or polygonal cross sections work as well. The solid lubricant 39 will always need to be sized and shaped to allow sufficient air flow through the main air passage 23 and around the lubricant 39. The solid lubricant 39 of the preferred embodiment is graphite. Other solid lubricants would be suitable under various conditions.

The compressed air travels from the surface down the drill pipe (not shown) to the hollow stem of the attached bit. Some of the air exits through nozzles 41 in the legs 5 to carry debris and cuttings out of the hole. Some of the air is pushed through the air tubes 25 into the main air passage 23 in each leg 5. As the air passes from the air tube 25 through the main air passage 23, it erodes the solid lubricant 39 that is in the main air passage 23. As particles of solid lubricant 39 are ablated into the air stream, they flow with the air through the ball passage 17 and into the bearing shaft air passage 27. The reduced diameter section 29 of the ball plug 21 retains the solid lubricant 39 in the main passage 23. Where an alternative to ball elements 15 is used, such as retaining clips, a sharp corner between the main air passage 23 and the bearing shaft air passage 27 will retain the solid lubricant 39 in the main air passage 23.

As the air stream, now laden with solid lubricant 39 particles, leaves the bearing shaft air passage 27 it encounters the bearing surfaces 31, 33, 35, 37. In the preferred embodiment the air flows through the bearing shaft air passage 27 near the thrust bearing 37. The air travels over all of the bearing surfaces 31, 33, 35, 37 as it is pushed out of the cutter 13. As the air travels over the bearing surfaces 31, 33, 35, 37, it cools them and deposits solid lubricant 39 particles. Once the air has exited the cutter 13, the air travels up to the top of the bore hole in the annulus between the bore hole walls and the drill pipe.

The erosion of a solid lubricant into the air stream of an air cooled bit, as described above and claimed below, has several advantages. Most of these advantages stem from the fact that the lubricant is added only to the airstream that cools the bearing surfaces and not to the airstream that is intended to remove cuttings and debris from the hole. This distinction saves money by reducing the amount of lubricant that is needed for a given operation. It also prevents any adverse effect the lubricant may have on the airstream's ability to remove cuttings. The invention can also be used with only minor modification of existing bits. This provides lubrication to extend the life of already proven bit designs.

While the invention has been shown in only one of its forms, it should be apparent to those skilled in the art that it is not so limited, but is susceptible to various changes without departing from the scope of the invention.

I claim:

1. An air cooled drill bit comprising:

a body with a hollow stem and at least one bearing shaft;

a cutter mounted to the bearing shaft along mating surfaces;

an air passage extending from the hollow stem to the mating surfaces; and a solid lubricant in the air passage in a position free of contact with the cutter for ablating particles of solid lubricant into the air passage.

2. The bit of claim 1 wherein the solid lubricant comprises graphite.

3. The bit of claim 1 wherein the mating surfaces consist of:

roller bearings disposed around the bearing shaft;

ball members located in a mating groove between the bearing shaft and the cutter for retaining the cutter on the bearing shaft; and a thrust bearing at an end of the bearing shaft.

4. The bit of claim 1 further comprising:

an air passage comprising:

a main air passage portion extending downward from the stem; and a ball passage portion extending from an outer surface into the bearing shaft; and where the solid lubricant is located in the main passage portion.

5. The bit of claim 4 further comprising a ball plug located in the ball passage portion, the solid lubricant being in contact with the ball plug.

6. The bit of claim 1 wherein the solid lubricant is cylindrical and of smaller outer diameter than an inner diameter of the portion of the air passage containing the solid lubricant so air can flow around the solid lubricant.

7. The bit of claim 1 further comprising a perforated air tube in the hollow stem to prevent debris from entering the air passage.

8. An air cooled drilling bit comprising:

a body with a hollow stem, at least one bit leg, and a bearing shaft depending from the bit leg;

a thrust bearing located between the cutter and an end of the bearing shaft a cutter rotatably mounted by roller bearings on the bearing shaft;

the journal and cutter having aligned ball element grooves;

a plurality of ball elements located in the grooves to retain the cutter on the bearing shaft;

a ball passage extending from an outer surface of the leg to the ball groove of the bearing shaft;

a main air passage extending from the hollow stem to the ball passage;

a thrust bearing air passage extending from the ball passage to the thrust bearing; and a solid lubricating element in the main air passage so that air flowing through the main air passage and ball passage erodes the lubricant element to deliver particles of lubricant through the roller bearings and thrust bearing.

9. The bit of claim 8 wherein the solid lubricant has a smaller diameter than an inner diameter of the main air passage by an amount sufficient to allow air to flow past.

10. The bit of claim 8 wherein the solid lubricant comprises graphite.

11. The bit of claim 8 further comprising:

a ball plug removably inserted in the ball passage to retain the ball elements in the ball grooves; and where a lower end of the solid lubricant contacts the ball plug.

12. The bit of claim 8 further comprising:

a perforated air tube mounted to the top of the main air passage to prevent debris from entering the main air passage.

13. A method for drilling bores in earthen formations comprising:

providing a drill bit with a hollow stem, at least one bearing shaft, a cutter rotatably mounted to the bearing shaft, and air passages leading from the stem to the bearing shaft;

mounting a solid lubricant in the air passages such that it is free of direct contact with the cutter;

securing the drill bit to the end of a drill stem;

rotating the drill bit into the earthen formation;

injecting a gas stream under pressure into the drill stem; and discharging the gas stream through passages in the drill bit to cool the cutter causing the solid lubricant to ablate into the gas stream and lubricate spaces between the cutter and the bearing shaft.

14. The method of claim 13 wherein:

the step of injecting the gas stream comprises injecting compressed air; and the step of mounting the solid lubricant comprises mounting a stick of graphite.

* * * * *